United States Patent [19]

Potter

[11] Patent Number: 4,925,147

[45] Date of Patent: May 15, 1990

[54] ARTIST'S EASEL

[76] Inventor: David J. Potter, 13 High St., Loddon, Norfolk NR14 6ET (GB), Great Britain

[21] Appl. No.: 322,919

[22] Filed: Mar. 14, 1989

[51] Int. Cl.[5] ..... A47B 97/04

[52] U.S. Cl. ..... 248/463; 248/166; 248/447; 248/449; 248/460

[58] Field of Search ..... 248/463, 464, 444.1, 248/447, 449, 452, 457, 460, 465, 150, 166

[56] References Cited

U.S. PATENT DOCUMENTS

| | | | |
|---|---|---|---|
| 544,083 | 8/1895 | Beyer | 248/449 |
| 989,699 | 4/1911 | Deem | 248/463 |
| 2,526,527 | 10/1950 | Zander | 248/463 |
| 3,738,066 | 6/1973 | Millen | 248/460 X |
| 4,042,203 | 8/1977 | Warkentin | 248/449 |
| 4,610,414 | 9/1986 | Schuck | 248/464 X |
| 4,703,910 | 11/1987 | Ross | 248/463 |
| 4,728,065 | 3/1988 | Coote | 248/150 X |

*Primary Examiner*—Ramon O. Ramirez
*Attorney, Agent, or Firm*—Neal J. Mosely

[57] ABSTRACT

An artist's easel comprises a framework adapted to receive and hold a canvas, and one or more wheels mounted on the framework and enabling the easel to be wheeled to and from a place of use. The easel also includes means for maintaining the frame in its normally intended attitude of use, and means which, in use, engage the ground on which the easel stands to resist any tendency of the easel to move along the ground.

7 Claims, 1 Drawing Sheet

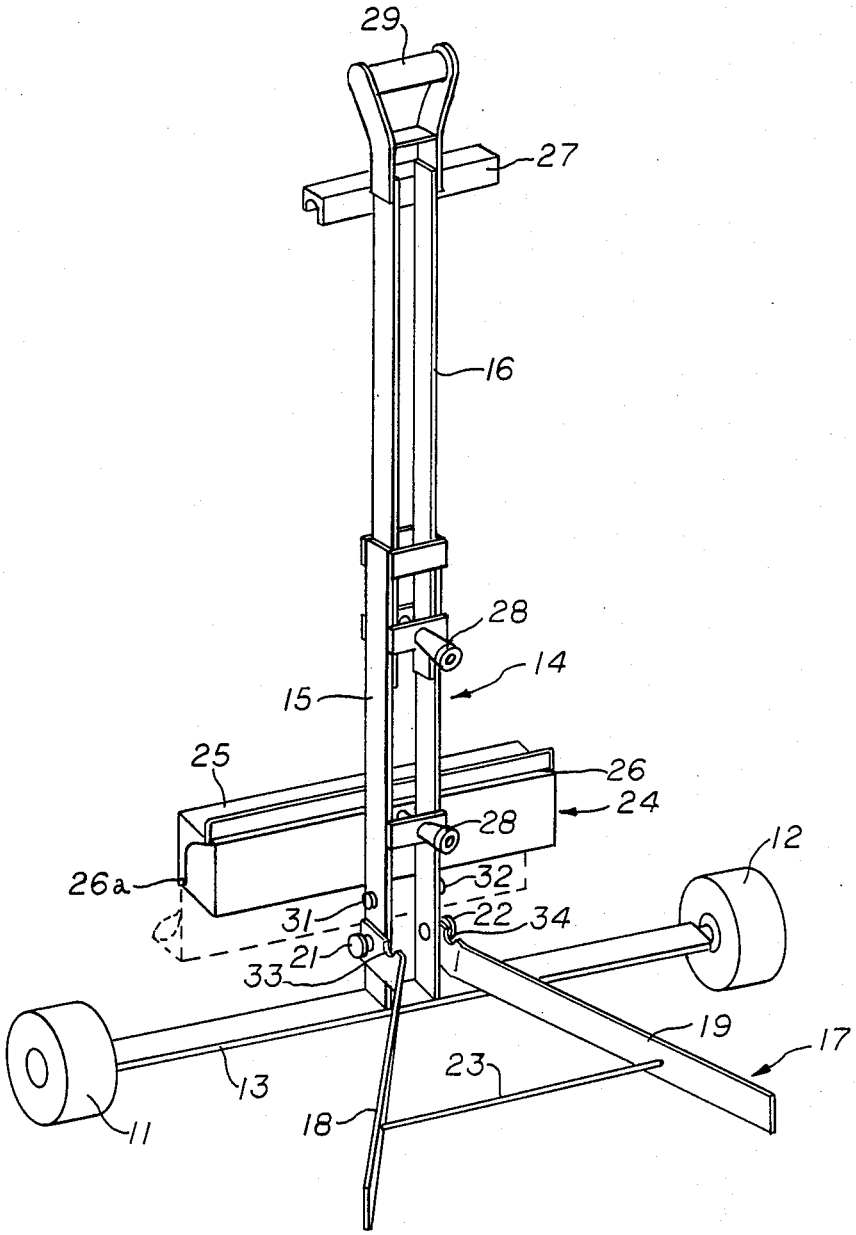
29
27
16
28
14
15
25
26
24
28
12
26a
32
31
22
34
21
33
19
17
23
13
11
18

ARTIST'S EASEL

FIELD OF THE INVENTION

The invention relates to artists' easels.

GENERAL INDICATION OF THE STATE OF THE ART

Artists' easels conventionally are wooden three-legged frame-works of much the same format as the traditional blackboard easel. Two of the three legs of the framework occupy substantially the same plane and, in use, support the painter's board or canvas from behind on a ledge which spans those two legs. The third leg of the framework projects to prop the other two—and hence the board or canvas—at an angle. The framework in use forms a tripod supporting the board or canvas above the ground at a generally comfortable working angle for the artist.

Artists' easels of this conventional kind are usually light in weight, and the third leg is designed to fold into the plane of the other two to form what nowadays would be referred to as a "flat-pack". The easel can thus be carried readily.

It does, however, literally have to be carried. It cannot be dragged along behind the artist without usually suffering damage. It cannot easily be carried together with its boards or canvasses, especially if those latter are large works. And it cannot normally be carried without disturbing the position of the board or canvas on the easel.

Neither does it incorporate, in conventional designs, any means for carrying the artist's materials other than his board or canvas.

The invention sets out to provide an artist's easel which is without these drawbacks.

SUMMARY OF THE INVENTION

The invention is summarised in the numbered claims ending, and forming part of, this specification. It includes within its scope an easel substantially as described herein with reference to and as illustrated in the accompanying drawings. It will now be illustrated by reference to those drawings.

BRIEF DESCRIPTION OF THE DRAWINGS

The single figure of the accompanying drawings shows one easel embodying the invention. This is only one example of forms which the invention might take within the scope of the claims. It is currently the best way known to the applicant of putting the invention into practice.

DESCRIPTION OF THE PREFERRED EMBODIMENT

An artist's easel consists essentially of wheels 11, 12 spaced apart by a rigid axle 13 supporting a mast 14. The mast 14 is telescopic with the stem 15 of the telescope fixed to the axle 13 and the barrel 16 of the telescope sliding within the stem 15. The stem 15 forms the base of the mast 14 whilst the barrel 16 forms the extensible and retractable arm of the mast.

Pivoted to the base 15 of the mast 14 is an essentially A-shaped framework 17. The limbs 18, 19 of this framework 17 are splayed outward from the pivot points respectively 21, 22 on the mast base 15. The cross-bar 23 of the A-frame 17 runs generally parallel with the axle 13 spanning the wheels 11, 12.

As shown in the drawing the A-frame 17 can be swung about its pivots 21 and 22 to form with the wheels 11, 12 a four-point ground contact supporting the mast 14 at an angle to the ground on which the easel stands. When the pivots 21 and 22 are tightened by rotating their conventional screw-threaded hand-operated clamping mechanisms as illustrated, the A-frame 17 is held rigidly against the mast 14 and the mast in turn is supported relatively rigidly at its projecting angle from the ground.

A lidded box 24 is fixed to the base of the mast 14 by a screw-threaded hand-operated conventional clamp 25. When the clamp 25 is slackened, the box 24 can be moved up and down the base 15 of the mast 14; and can be fixed in a selected position, within its range of movement, by tightening the clamp 25.

The top surface of the box 25 supports a ledge 26 which runs along the length of the box, at right angles to the run of the mast 14, and which is spaced from the mast base members by an amount sufficient for a board or canvas to occupy the spacing gap and to rest, behind the ledge 26, on the top surface of the box 24.

An angle bar 27 is fixed non-adjustably to the extensible and retractable arm 16 of the mast 14. The screw-threaded hand-operated clamp 28 which, when slackened, allows the arm 16 to be extended and retracted, and when tightened, holds the arm 16 in a selected position within its range of extension and retraction, is used to set the bar 27 at an appropriate height.

An appropriate height, in the context just outlined, is a height at which the board or canvas resting on top of the box 24 behind the ledge 26 can have its top edge located—not necessarily clamped—by the bar 27.

In this embodiment, the bar 27 is lipped along its front edge to assist in locating the board or canvas.

Also in this embodiment, the lid 25 of the box 24 swings open about a hinge 26, running the length of the box, to hang down in a position illustrated in broken line in which it forms effectively a tray for artists' materials. When the lid is closed, and not acting as a tray, the box 24 carries the artist's materials safely.

The lid 25 closes, as will be appreciated, against the front of the ledge 26. The ledge 26 does not move relative to the non-lidded region of the box. The means of fastening the lid 25 shut, and/or of fixing it in its opened downward-hanging position (if this is found necessary), form no inventive feature of the easel and can be left to the intended skilled addressee of this specification to select.

A handle 29 is formed at, and fixed to, the projecting end of the mast arm 16. The handle 29 enables the easel to be pulled along the ground on its wheels 11, 12 when the artist is not working at it; and when the A-frame 17 has been swung into and held in its out-of-use position.

To swing the frame 17, the clamps 21 and 22 are released and the frame pivots into a position in which it occupies substantially the same plane as the mast base 15 and mast arm 16. As illustrated, stops 31 and 32, fixed to the mast base arms, engage cutouts 33, 34 respectively in the limbs 18 and 19 of the A-frame to allow the frame 17 to occupy substantially the same plane as the mast arms.

In that position, and with the clamps 21 and 22 tightened again, the A-frame 17 assists the mast and the ledge-box surface in supporting the board or canvas (not shown). The board or canvas therefore need not be removed from the easel when the easel is wheeled along the ground.

To stop the wheels 11, 12 rotating whilst the easel is in use, a number of means could be employed. Conventional foot-operated braking means such as those used on foldable child's "buggies" (lightweight pushchairs) could be used. Alternatively or additionally, if the wheels were spoked, a strap running through the wheels and round the A-frame 17 and/or the mast 14 could, when tightened, effectively hold the wheels still.

The same strap just referred to could, when first removed to allow the A-frame 17 to swing up into its canvas-supporting out-of-use position, then be strapped around the canvas and run through the frame and/or the mast to hold the canvas securely in position side-to-side whilst the easel and canvas were being wheeled along.

Provision may be made for a sunshade or umbrella to open from the easel and afford protection from the sun or a light shower.

The box may incorporate a palette that folds in such a way that wet paint left on the palette is kept from brushes in the box.

I claim:

1. An artist's easel comprising a framework comprising a horizontally oriented base member and upper and lower telescopically-connected, vertically-extending members, the lower member being fixed centrally of said base member a pair of wheels mounted on opposite ends of said base member enabling said easel framework to be wheeled to and from a place of use;

an upper clamping member fixed on said upper vertically-extending member, adjusable by movement of said upper vertically-extending member, and including means for securing a canvas to said framework, a lower clamping member adjustably supported for vertical movement on said lower vertically-extending member and means for securing the same in a selected fixed position relative to said upper clamping member, said lower clamping means further including means to secure a canvas on said framework during movement, means comprising an A-frame having its apex pivotally mounted on the lower end of said lower vertically-extending member and means to secure the same either in a position with the legs of the A-frame substantially coplanar with said vertically extending members permitting movement of said easel on said wheels, or in a downwardly and outwardly extending position to engage the ground and secure the easel against movement along the ground, and said A-frame defines a planar support for a canvas when the easel is being wheeled when said A-frame is secured in said position against said vertically-extending members.

2. An easel according to claim 1 in which said upper vertically-extending member has a handle member secured on its upper end.

3. An easel according to claim 1 in which said vertically extending members include stop means for holding said A-frame in said position defining a planar support.

4. An easel according to claim 1 in which said lower clamping member adjustably supported for vertical movement on said lower vertically-extending member comprises an elongated box for painter's equipment, said box having a front-opening lid permitting access to said supplies when open and defining a canvas-clamping ledge when closed.

5. An easel according to claim 1 in which said upper and lower telescopically-connected, vertically-extending members each comprise a pair of support members secured in a fixed, spaced, parallel relation, said A-frame having legs pivotally mounted one on each of said parallel support members forming said lower vertically-extending member at the lower end thereof and releasable clamping means to secure the same in a position with the legs of the A-frame against said vertically extending members permitting movement of said easel on said wheels, or in a downwardly and outwardly extending position to engage the ground and secure the easel against movement along the ground.

6. An easel according to claim 5 in which said A-frame includes a cross support member positioned to engage the rear of said parallel support members forming said upper and lower telescopically-connected, vertically-extending members to locate the front edge of the legs of said A-frame in a coplanar relation with the front edges of said parallel support members.

7. An easel according to claim 5 in which said upper vertically-extending member has a handle member secured on its upper end between said upper parallel support members.

* * * * *